US011225720B2

(12) United States Patent
Lee et al.

(10) Patent No.: US 11,225,720 B2
(45) Date of Patent: Jan. 18, 2022

(54) MAGNETIC POWDER, AND MANUFACTURING METHOD THEREOF

(71) Applicant: SAMSUNG ELECTRO-MECHANICS CO., LTD., Suwon-si (KR)

(72) Inventors: Sung Jae Lee, Suwon-si (KR); Jung Wook Seo, Suwon-si (KR); Hiroyuki Matsumoto, Suwon-si (KR); Chul Min Sim, Suwon-si (KR); Jong Sik Yoon, Suwon-si (KR); Jong Suk Jung, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 463 days.

(21) Appl. No.: 16/139,696

(22) Filed: Sep. 24, 2018

(65) Prior Publication Data

US 2019/0024245 A1 Jan. 24, 2019

Related U.S. Application Data

(63) Continuation of application No. 15/072,594, filed on Mar. 17, 2016, now Pat. No. 10,161,049.

(30) Foreign Application Priority Data

Mar. 19, 2015 (KR) ..... 10-2015-0038273

(51) Int. Cl.
*H01F 1/24* (2006.01)
*H01F 1/33* (2006.01)
(Continued)

(52) U.S. Cl.
CPC ..... *C23D 5/04* (2013.01); *B22F 1/02* (2013.01); *H01F 1/24* (2013.01); *H01F 1/33* (2013.01); *C22C 33/02* (2013.01)

(58) Field of Classification Search
CPC ..... H01F 1/24; H01F 1/33; B22F 1/02
See application file for complete search history.

(56) References Cited

FOREIGN PATENT DOCUMENTS

JP 2010-232224 A 10/2010
JP 2012-049203 A 3/2012
(Continued)

OTHER PUBLICATIONS

Office Action issued in corresponding Korean Patent Application No. 10-2015-0038273 dated Dec. 13, 2019, with English translation.

(Continued)

*Primary Examiner* — Matthew E. Hoban
(74) *Attorney, Agent, or Firm* — Morgan, Lewis & Bockius LLP

(57) ABSTRACT

A magnetic powder contains magnetic particles, a first coating layer disposed on surfaces of the magnetic particles and containing a first glass, and a second coating layer disposed on the first coating layer and containing a second glass different from the first glass. A method of manufacturing magnetic powder includes preparing magnetic particles, forming a first coating layer containing a first glass on surfaces of the magnetic particles, and forming a second coating layer containing a second glass different from the first glass on the first coating layer.

13 Claims, 4 Drawing Sheets

(51) Int. Cl.

| | |
|---|---|
| ***B22F 1/02*** | (2006.01) |
| ***C23D 5/04*** | (2006.01) |
| *C22C 33/02* | (2006.01) |

(56) References Cited

FOREIGN PATENT DOCUMENTS

| | | | | |
|---|---|---|---|---|
| JP | 2012-230948 | A | | 11/2012 |
| JP | 2010-232224 | | * | 10/2014 |
| KR | 10-2014-0025063 | A | | 3/2014 |
| WO | 2012/146967 | A1 | | 11/2012 |

OTHER PUBLICATIONS

Notice of Allowance issued in U.S. Appl. No. 15/072,594, dated Sep. 7, 2018 (available via USPTO PAIR System).
Final Office Action issued in U.S. Appl. No. 15/072,594, dated Jul. 11, 2018 (available via USPTO PAIR System).
Non-Final Office Action issued in U.S. Appl. No. 15/072,594, dated Dec. 29, 2017 (available via USPTO PAIR System).

* cited by examiner

MAGNETIC POWDER, AND MANUFACTURING METHOD THEREOF

CROSS-REFERENCE TO RELATED APPLICATION

This application is a continuation application of U.S. application Ser. No. 15/072,594 which claims benefit of priority to Korean Patent Application No. 10-2015-0038273, filed on Mar. 19, 2015 with the Korean Intellectual Property Office. The disclosures of U.S. application Ser. No. 15/072,594 and Korean Patent Application No. 10-2015-0038273 are incorporated herein by reference.

TECHNICAL FIELD

The present disclosure relates to a magnetic powder, a manufacturing method thereof, and a coil electronic component containing magnetic powder.

BACKGROUND

Among passive elements, a coil electronic component may include a coil part and a body enclosing the coil part, wherein the body may be formed to contain a magnetic material.

In this case, the magnetic material contained in the body may be contained in a form of magnetic powder, and in order to decrease an eddy current loss in a high frequency band, insulation between magnetic particles contained in the body should be secured.

Further, in a case in which the magnetic powder is metal based powder, there is an advantage in that a saturation magnetization value is high, but when an available frequency is increased, a core loss caused by the eddy current loss may be increased, and thus efficiency may be deteriorated. Therefore, it is very important to improve insulation properties of the magnetic particles.

SUMMARY

An aspect of the present disclosure may provide a magnetic powder, a manufacturing method thereof, and a coil electronic component containing magnetic powder.

According to an aspect of the present disclosure, a magnetic powder may contain magnetic particles and a coating layer disposed on the magnetic particles in order to improve insulation properties between particles contained in the magnetic powder. The coating layer includes a first coating layer containing a first glass and a second coating layer containing a second glass to thereby be composed of at least two layers.

The second glass may have a softening point lower than that of the first glass.

According to another aspect of the present disclosure, a manufacturing method of magnetic powder and a coil electronic component containing the magnetic powder are provided.

According to another aspect of the present disclosure, a magnetic material may include a magnetic particle, a first coating layer completely surrounding the magnetic particle and containing a first glass, and a second coating layer completely surrounding the first coating layer and containing a second glass different from the first glass.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
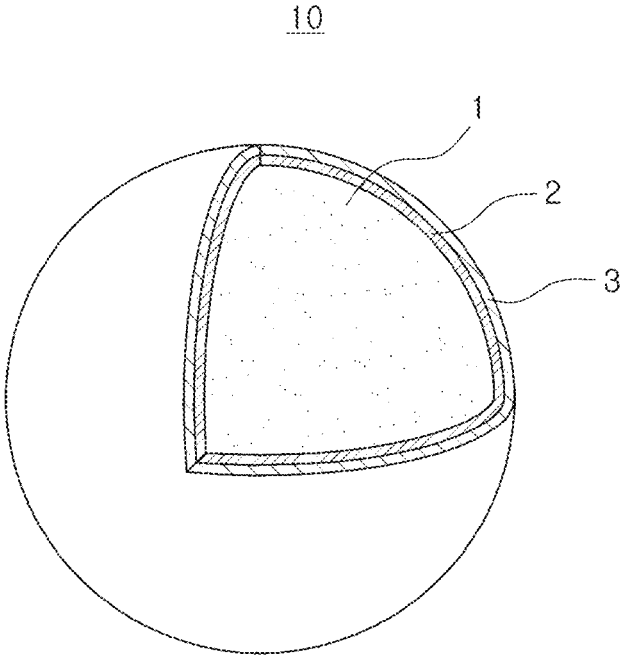
FIG. 1 is a partially cut perspective view illustrating one particle of magnetic powder according to an exemplary embodiment in the present disclosure.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Magnetic Powder and Manufacturing Method Thereof

Figure 2:
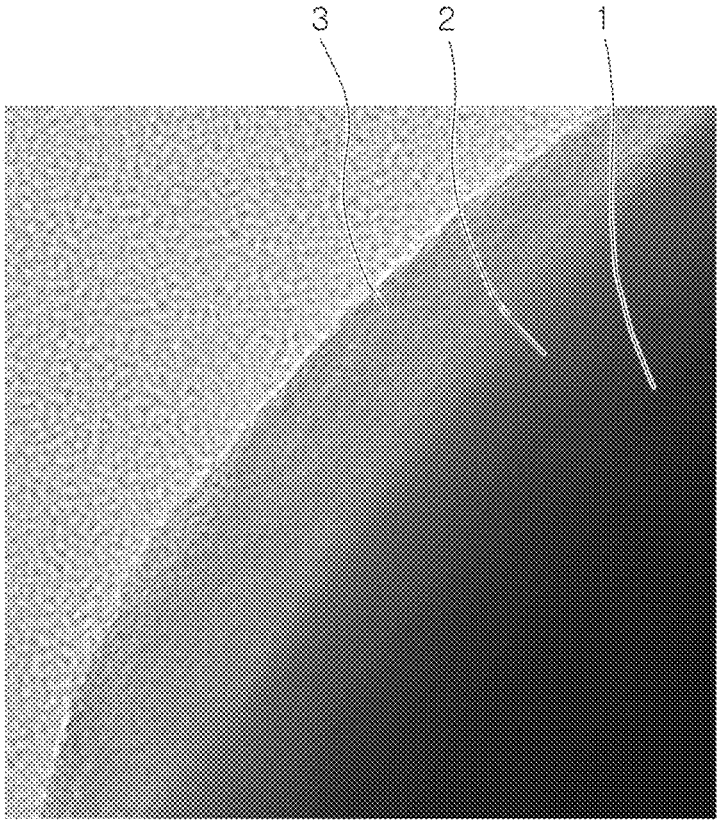
FIG. 2 is a transmission electron microscope (TEM) photograph of one particle of the magnetic powder according to the exemplary embodiment in the present disclosure.

FIG. 1 is a partially cut perspective view illustrating one particle of magnetic powder according to an exemplary embodiment in the present disclosure, and FIG. 2 is a transmission electron microscope (TEM) photograph of one particle of the magnetic powder according to the exemplary embodiment in the present disclosure.

Referring to FIGS. 1 and 2, magnetic powder 10 according to the exemplary embodiment may contain magnetic particles 1 and coating layers 2 and 3 disposed on the magnetic particles 1. The coating layer includes first and second coating layers 2 and 3 to thereby be composed of at least two layers.

According to the exemplary embodiment, the magnetic powder 10 may be used in a coil electronic component. For example, the magnetic powder 10 may be used in inductors, beads, filters, or the like, but is not limited thereto.

The magnetic particle 1 is not particularly limited as long as it has magnetic properties, and the magnetic particle 1 may be formed of a metal particle.

In a case in which the magnetic particle 1 is formed of the metal particle, a saturation magnetic flux density may be high, and a decrease in L value may be prevented even at a high current.

For example, the magnetic particle 1 may contain at least one material selected from the group consisting of iron (Fe) based alloys.

In a case in which the magnetic particle 1 is formed of the iron (Fe) based alloy, the magnetic particle may have a high saturation magnetization density. The iron (Fe) based alloy may be an amorphous alloy or a nano-crystalline alloy.

The iron (Fe) based alloy, which is obtained by adding at least one alloy element that is different from iron (Fe) to iron (Fe), may have properties of a metal. The alloy element is not particularly limited as long as it may increase electric resistance, improve permeability, and improve specific resistance so as to be used at a high frequency. For example, the alloy element may include at least one of phosphorus (P), boron (B), silicon (Si), carbon (C), aluminum (Al), chromium (Cr), and molybdenum (Mo).

Although not limited, the iron (Fe) based alloy may be, for example, an Fe—Si—B based amorphous alloy or an Fe—Si—B based nano-crystalline alloy.

In a case in which the iron (Fe) based alloy is formed of the amorphous alloy or the nano-crystalline alloy, specific resistance of the magnetic particle may be increased, and thus when the magnetic particles are applied to an electronic component, the electronic component may be used in a high frequency band.

Although not limited, a particle size of the magnetic particle 1 may be 5 μm to 100 μm. The coating layer will be described below, but according to the exemplary embodiment, even though the magnetic particle 1 has a small particle size of 5 μm to 100 μm, insulation properties may be implemented by securing a thickness of the coating layer disposed on the magnetic particle 1.

According to the exemplary embodiment, the first coating layer 2 may be disposed on a surface of the magnetic particle 1, and the second coating layer 3 may be disposed on the first coating layer 2.

The first coating layer 2 may contain a first glass, and the second coating layer 3 may contain a second glass. The first glass and the second glass are different materials from each other.

According to the exemplary embodiment, the second glass may have a softening point lower than that of the first glass.

The first coating layer 2 may be formed by softening first glass powder formed of the first glass using heat generated by mechanical friction and coating the softened first glass on the surface of the magnetic particle 1.

In addition, the second coating layer 3 may be formed by softening second glass powder formed of the second glass using heat generated by mechanical friction and coating the softened second glass on the first coating layer 2 of the magnetic particle 1.

In a case of forming a coating layer by softening glass powder using heat generated by mechanical friction to coat the softened glass powder on a surface of a magnetic particle, there is a problem in that a thickness of the coating layer may be limited depending on a size of the magnetic particle. As the size of the magnetic particle is decreased, the problem as described above may be further exaggerated.

Meanwhile, according to the exemplary embodiment, since the second glass has a softening point lower than that of the first glass, the thickness of the coating layer formed on the magnetic particle may be increased by preventing the first coating layer 2 formed on the magnetic particle 1 from being re-softened while the second coating layer 3 is formed, and thus, insulation properties and specific resistance of the magnetic powder 10 may be improved.

According to the exemplary embodiment, a difference in the softening point between the first glass and the second glass may be 20° C. or more, but is not limited thereto. In a case in which the difference in the softening point between the first glass and the second glass is less than 20° C., it may be difficult to allow the first glass contained in the first coating layer 2 to maintain a stable solid phase while the second coating layer 3 is formed, and thus it may be difficult to form the second coating layer 3 on the first coating layer 2. In addition, while the second coating layer 3 is formed, a thickness of the first coating layer 2 may be decreased due to re-softening of the first coating layer 2, and thus it may be difficult to secure the thickness of the coating layer formed on the magnetic particle.

Meanwhile, in a case in which the magnetic particle is formed of the amorphous alloy or the nano-crystalline alloy, in order to prevent crystallization of the magnetic particle, preferably, the softening points of the first and second glass may be 500° C. or less.

Meanwhile, according to the exemplary embodiment, the first and second glass may have different specific resistance values from each other, and thus the first and second coating layers may have different specific resistance values from each other.

In a case in which the first and second coating layers 2 and 3 are formed of materials having different specific resistance values from each other as described above, there is an advantage in that specific resistance of the magnetic powder may be easily adjusted.

Although not limited, each of the first and second glass may include one or more selected from $P_2O_5$—ZnO based glass (glass transition temperature (Tg): about 300-360° C.), $Bi_2O_3$—$B_2O_3$ based glass (glass transition temperature (Tg): about 370-500° C.), $SiO_2$—$B_2O_3$ based glass (glass transition temperature (Tg): about 410-500° C.), and $SiO_2$—$Al_2O_3$ based glass (glass transition temperature (Tg): about 510-550° C.).

Figure 3:
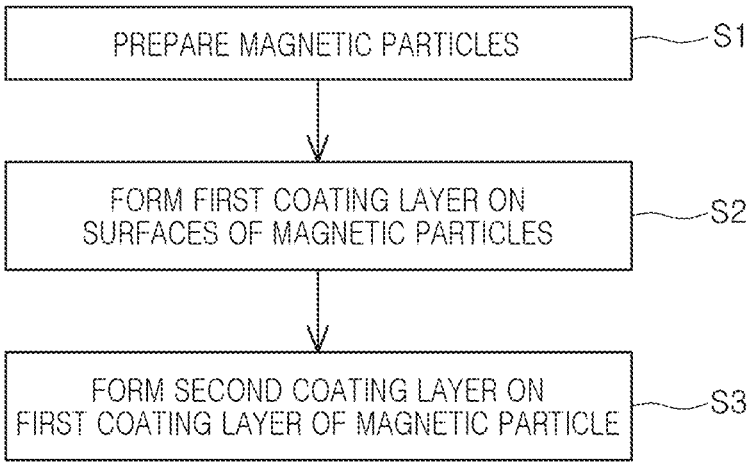
FIG. 3 is a flowchart illustrating a manufacturing method of magnetic powder according to an exemplary embodiment in the present disclosure.

FIG. 3 is a flow chart illustrating a method of manufacturing a magnetic powder according to an exemplary embodiment in the present disclosure.

Referring to FIG. 3, the method of manufacturing magnetic powder according to the exemplary embodiment may include preparing magnetic particles (S1), forming a first coating layer on surfaces of the magnetic particles (S2), and forming a second coating layer on the first coating layer (S3).

Although not limited, the first and second coating layers may be formed using a dry-coating device.

Figure 4:
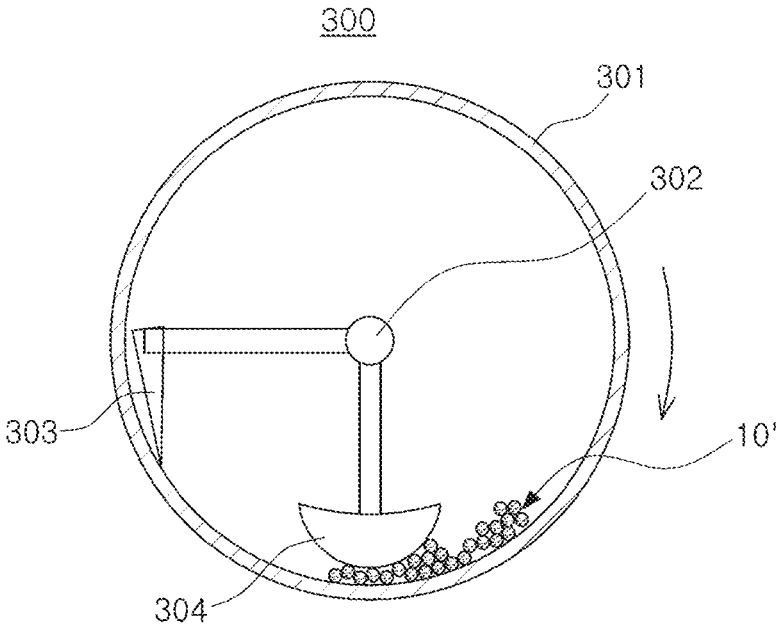
FIG. 4 is a mimetic view schematically illustrating an example of a dry-coating device.

FIG. 4 is a mimetic view schematically illustrating a dry-coating device 300 softening glass powder using heat generated by mechanical friction and coating the softened glass powder on surfaces of magnetic particles to forma coating layer on the surfaces of the particles.

For example, the dry-coating device 300 may include a chamber 301, a friction part 303 rapidly rotating based on a shaft 302 as an axis, and a blade 304 as illustrated in FIG. 4. When the magnetic particle powder and glass powder are injected into the chamber 301, the glass powder may be adsorbed on surfaces of the magnetic particles while being softened by friction heat between powders 10' caused by high-speed rotation, thereby forming a coating layer.

The forming of the first coating layer 2 may be performed by softening first glass powder formed of a first glass using heat generated by mechanical friction and coating the softened first glass on the surface of the magnetic particle 1.

For example, the first coating layer 2 may be formed by injecting a mixture of magnetic particles and first glass powder into the chamber 301 of the dry-coating device 300, generating friction heat by high-speed rotation to soften the first glass powder, and coating the softened first glass powder on the surfaces of the magnetic powder.

Further, the forming of the second coating layer 3 may be performed by softening second glass powder formed of a second glass using heat generated by mechanical friction and coating the softened second glass on the first coating layer 2 of the magnetic particle 1.

For example, the second coating layer 3 may be formed by injecting a mixture of magnetic particles 1 on which the first coating layer 2 is formed and second glass powder into the chamber 301 of the dry-coating device 300, generating friction heat by high-speed rotation to soften the second glass powder, and coating the softened second glass powder on the first coating layer 2 formed on the surface of the magnetic particle 1.

In this case, according to the exemplary embodiment, since a softening point of the second glass may be higher than that of the first glass, a thickness of the coating layer formed on the magnetic particle 1 may be increased by preventing a thickness of the first coating layer 2 from being decreased by the re-softening of the first coating layer when the second coating layer 3 is formed, and thus, insulation properties and specific resistance of the magnetic powder may be improved.

Further, according to the exemplary embodiment, since both of the first and second coating layers 2 and 3 contain glass, the first and second coating layers 2 and 3 may be formed using methods similar to each other or the same manufacturing device as each other, and thus a manufacturing process of the magnetic powder may be simplified.

Among descriptions of the method of manufacturing magnetic powder, a description of the same features as those of the magnetic powder according to the exemplary embodiment in the present disclosure described above will be omitted in order to avoid an overlapping description.

Coil Electronic Component and Manufacturing Method Thereof

Figure 5:
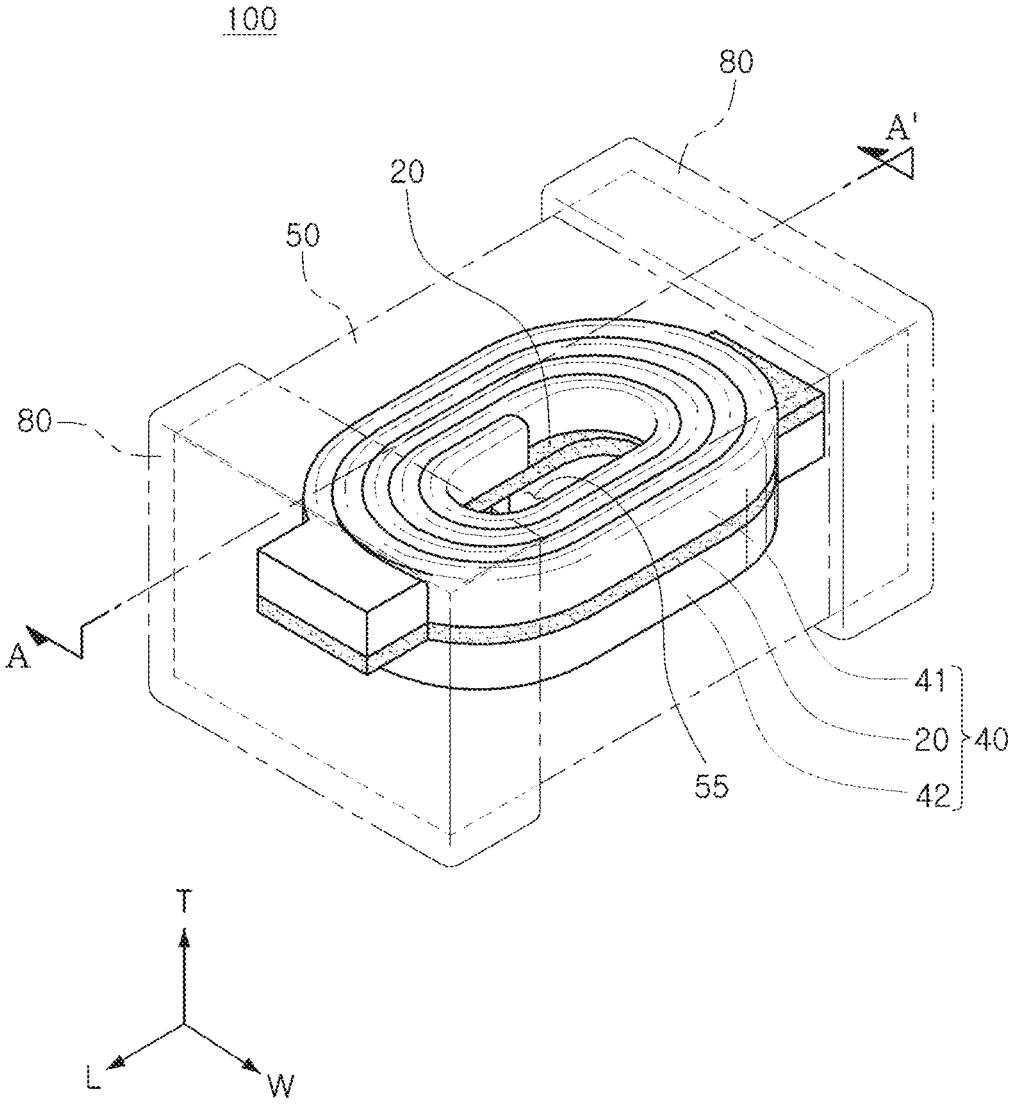
FIG. 5 is a schematic perspective view illustrating a coil electronic component according to an exemplary embodiment in the present disclosure so that a coil part disposed therein is visible.
Figure 6:
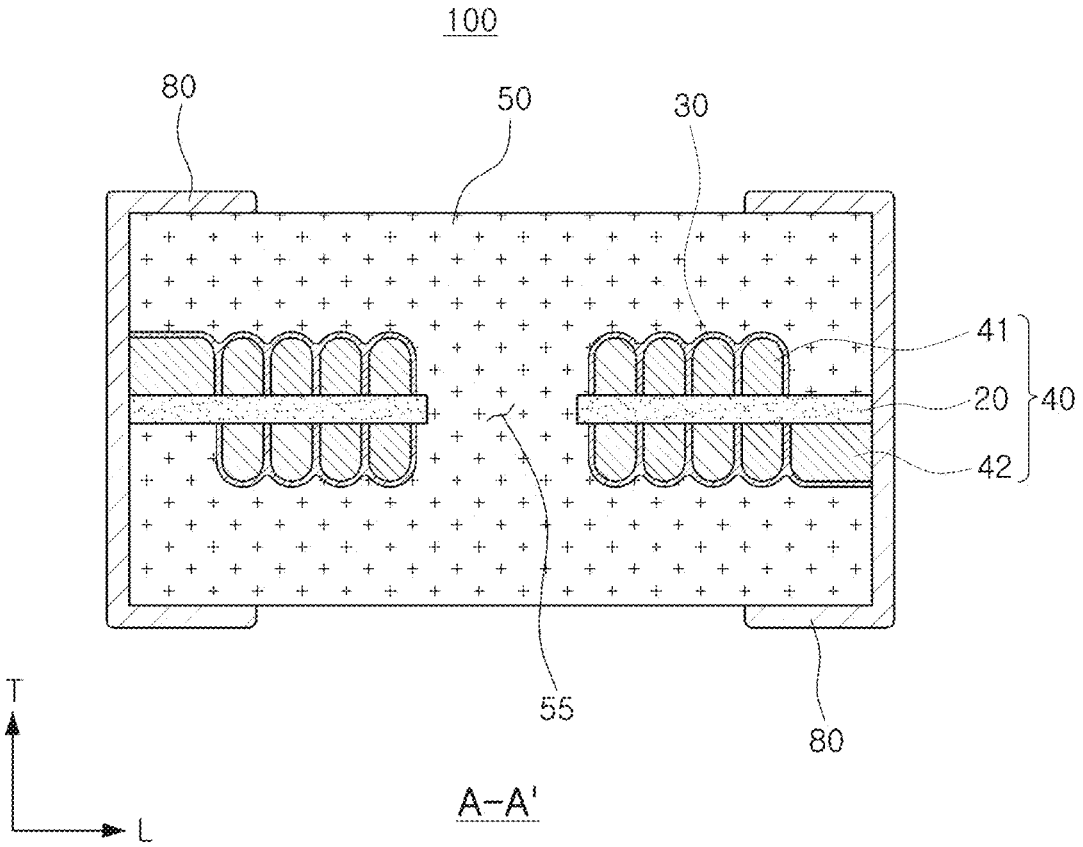
FIG. 6 is a cross-sectional view taken along line A-A' of FIG. 5.

FIG. 5 is a schematic perspective view illustrating a coil electronic component according to an exemplary embodiment in the present disclosure so that a coil part disposed therein is visible, and FIG. 6 is a cross-sectional view taken along line A-A' of FIG. 5.

Referring to FIGS. 5 and 6, an inductor used in a power supply line of a power supply circuit is illustrated as an example of the coil electronic component, but the coil electronic component according to the exemplary embodiment may be appropriately applied to beads, a filter, and the like, as well as the inductor.

In addition, a thin film type inductor will be described as an example of the inductor, but the coil electronic component is not limited thereto. That is, the coil electronic component according to the exemplary embodiment may be appropriately applied to a multilayer type inductor or a winding type inductor.

The coil electronic component 100 may include a body 50 and external electrodes 80, wherein the body 50 includes a coil part 40.

The body 50 may have a substantially hexahedral shape, and L, W, and T illustrated in FIG. 1 refer to a length direction, a width direction, and a thickness direction, respectively.

Although not limited, the body 50 may have first and second surfaces opposing each other in the thickness direction, third and fourth surfaces opposing each other in the length direction, and fifth and sixth surfaces opposing each other in the width direction. The body 50 may have a rectangular parallelepiped shape so that a length thereof in the length direction is greater than a length thereof in the width direction.

The body 50 may form an exterior of the coil electronic component 100, and may contain the magnetic powder according to the exemplary embodiment described above.

The magnetic powder may contain magnetic particles, a first coating layer disposed on surfaces of the magnetic particles and containing a first glass, and a second coating layer disposed on the first coating layer and containing a second glass different from the first glass.

According to the exemplary embodiment, the second glass may have a softening point lower than that of the first glass.

Meanwhile, a difference in the softening point between the first and second glass may be 20° C. or more.

Among descriptions of the magnetic powder contained in the body, a description of the same features as those of the magnetic powder according to the exemplary embodiment described above will be omitted in order to avoid an overlapping description.

The magnetic powder may be contained in the body 50 in a state in which the magnetic powder is dispersed on a polymer such as an epoxy resin, polyimide, or the like.

As illustrated in FIGS. 5 and 6, the coil part 40 may be disposed in the body 50. The coil part 40 may include a base layer 20, and coil patterns 41 and 42 disposed on at least one surface of the base layer 20.

The base layer 20 may contain, for example, polypropylene glycol (PPG), a ferrite, or a metal-based soft magnetic material, or the like.

A through hole may be formed in a central portion of the base layer 20 and filled with the magnetic powder contained in the body 50, thereby forming a core part 55. As the core part 55 is formed by filling the through hole with the magnetic powder, inductance L of the inductor may be improved.

A first coil pattern 41 having a coil shape may be formed on one surface of the base layer 20, and a second coil pattern 42 having a coil shape may be formed on the other surface of the base layer 20 opposing one surface of the base layer 20.

The coil patterns 41 and 42 may be formed in a spiral shape on one surface and the other surface of the base layer 20, respectively, and may be electrically connected to each other through a via electrode (not illustrated) formed in the base layer 20.

One end portion of the first coil pattern 41 disposed on one surface of the base layer 20 may be exposed to the one surface of the body 50 in the length direction, and one end portion of the second coil pattern 42 disposed on the other surface of the base layer 20 may be exposed to the other surface of the body 50 in the length direction.

The external electrodes 80 may be formed on both surfaces of the body 50 in the length direction to be connected to the exposed end portions of the coil patterns 41 and 42. The coil patterns 41 and 42, the via electrode (not illustrated), and the external electrodes 80 may be formed of a metal having excellent electrical conductivity. For example, the coil patterns 41 and 42, the via electrode (not illustrated), and the external electrodes 80 may be formed of silver (Ag), copper (Cu), nickel (Ni), aluminum (Al), alloys thereof, or the like.

According to the exemplary embodiment, the coil patterns 41 and 42 may be covered by an insulating layer 30.

The insulating layer 30 may be formed by a method known in the art such as a screen printing method, an exposure and development method using a photo resist (PR), a spray application method, or the like. The coil patterns 41 and 42 may be covered by the insulating layer 30, and thus the coil patterns 41 and 42 may not directly contact the magnetic material contained in the body 50.

Figure 7:
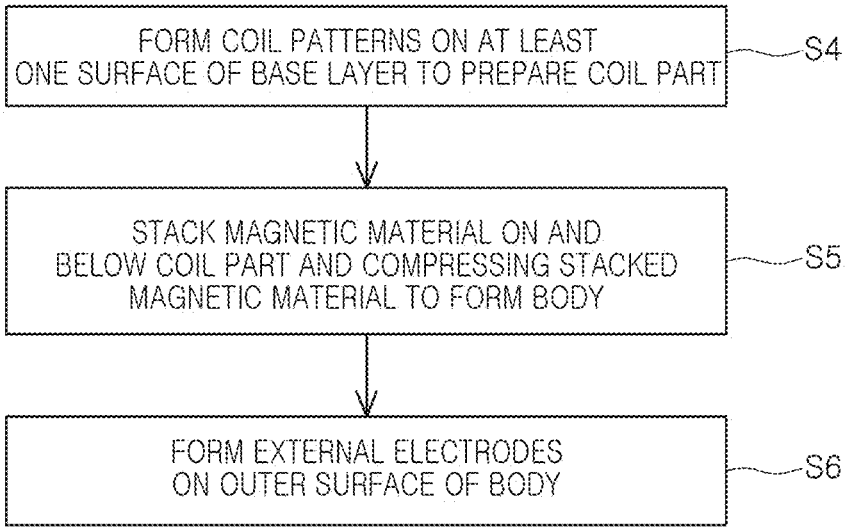
FIG. 7 is a flow chart illustrating a method of manufacturing a coil electronic component according to an exemplary embodiment in the present disclosure.

FIG. 7 is a flow chart illustrating a method of manufacturing a coil electronic component according to an exemplary embodiment in the present disclosure.

Referring to FIG. 7, the method of manufacturing a coil electronic component according to the exemplary embodiment may include forming coil patterns on at least one surface of a base layer to prepare a coil part (S4) and stacking a magnetic material on and below the coil part and compressing the stacked magnetic material to form a body (S5).

Meanwhile, the method of manufacturing a coil electronic component according to the exemplary embodiment may further include, after the forming of the body, forming external electrodes on an outer surface of the body (S6).

The forming of the coil patterns 41 and 42 may include forming a plating resist having an opening for forming a coil pattern on a base layer 20. As the plating resist, which is a general photosensitive resist film, a dry film resist, or the like, may be used, but the plating resist is not particularly limited thereto.

The coil patterns 41 and 42 may be formed by providing an electrically conductive metal in the opening for forming a coil pattern using an electroplating method, or the like.

The coil patterns 41 and 42 may be formed of a metal having excellent electric conductivity. For example, the coil patterns 41 and 42 may be formed of silver (Ag), palladium (Pd), aluminum (Al), nickel (Ni), titanium (Ti), gold (Au), copper (Cu), platinum (Pt), alloys thereof, or the like.

The coil part 40 in which the coil patterns 41 and 42 are formed on the base layer 20 may be formed by removing the plating resist using a chemical etching method, or the like, after forming the coil patterns 41 and 42.

A via electrode (not illustrated) may be formed by forming a hole in a portion of the base layer 20 and providing a conductive material in the hole, and the coil patterns 41 and 42 formed on one surface and the other surface of the base layer 20 may be electrically connected to each other through the via electrode.

The hole penetrating through the base layer may be formed in a central portion of the base layer 20 by a drilling method, a laser method, a sand blasting method, a punching method, or the like.

Selectively, after the coil patterns 41 and 42 are formed, an insulating layer 30 covering the coil patterns 41 and 42 may be formed. The insulating layer 30 may be formed by a method known in the art such as a screen printing method, an exposure and development method using a photo resist (PR), a spray application method, or the like, but a formation method of the insulating layer 30 is not limited thereto.

Next, the body 50 may be formed by disposing the magnetic material on and below the base layer 20 on which the coil patterns 41 and 42 are formed.

The magnetic material may be disposed on and below the base layer 20 in a form of a magnetic layer.

The body 50 may be formed by stacking the magnetic layers on both surfaces of the base layer 20 on which the coil patterns 41 and 42 are formed and compressing the stacked magnetic layers using a lamination method or an isostatic pressing method. In this case, a core part 55 may be formed by filling the hole with the magnetic material.

Here, the magnetic layer may contain a magnetic paste composition for a coil electronic component, wherein the magnetic paste composition for a coil electronic component may contain the magnetic powder contained in the body of the coil electronic component according to the exemplary embodiment described above.

Since, among the description of the method of manufacturing a coil electronic component according to the exemplary embodiment in the present disclosure, a description of the magnetic powder contained in the coil electronic component described above may be equally applied, a detailed description thereof will be omitted in order to avoid an overlapping description.

Next, the external electrodes 80 may be formed to be connected to the end portions of the coil patterns 41 and 42 exposed to at least one surface of the body 50.

The external electrodes 80 may be formed using a paste containing a metal having excellent electrical conductivity. The conductive paste may be a conductive paste containing, for example, one of nickel (Ni), copper (Cu), tin (Sn), and silver (Ag) alloys thereof, or the like. The external electrodes 80 may be formed by a dipping method, or the like, as well as a printing method, according to a shape of the external electrodes 80.

A description of the same features as those of the above-mentioned coil electronic component according to the exemplary embodiment will be omitted in order to avoid an overlapping description.

Experimental Example

The following Table 1 illustrates results obtained by measuring powder resistances of magnetic powder (sample 1) formed of Fe—Si—B based amorphous alloy powder on which no coating layer was not formed, magnetic powder (sample 2) on which a coating layer is formed of $SiO_2$—$B_2O_3$ based glass powder having a relatively high glass transition temperature (Tg) to have a single layer structure on Fe—Si—B based amorphous alloy powder, and magnetic powder (sample 3) on which a first coating layer is formed of $SiO_2$—$B_2O_3$ based glass powder on Fe—Si—B based amorphous alloy powder and a second coating layer is additionally formed of $P_2O_5$ based glass powder having a glass transition temperature (Tg) lower than that of the $SiO_2$—$B_2O_3$ based glass powder on the first coating layer.

Measurement of the powder resistivity is a suitable evaluation method capable of confirming the presence or absence and a degree of insulation between metal powders. In the present Experimental Example, after charging the magnetic powder of each of the samples in a mold, the powder resistivity was measured at four points using four terminals while applying pressure using a hydraulic press.

TABLE 1

| Sample | Powder Resistivity (Ω · cm) |
|---|---|
| 1 | $10^{-1}$ |
| 2 | $10^{1}$ |
| 3 | $10^{3}$ |

As a measurement result, when pressure of 0.65 ton/cm$^2$ was applied, powder resistivity of sample 1 was about 0.1 Ω·cm, powder resistivity of sample 2 was about 1 Ω·cm, and powder resistivity of sample 3 was about 1000 Ω·cm. Therefore, it may be confirmed that in the case of the sample 3 containing the first and second coating layers as in the exemplary embodiment, the powder resistivity was increased by $10^4$ orders or more as compared to sample 1 and by $10^3$ orders or more as compared to sample 2.

As set forth above, according to exemplary embodiments, the magnetic powder of which the insulation properties are improved, and a method of manufacturing thereof may be provided.

Further, the coil electronic component capable of operating in a high frequency band and decreasing an eddy current loss by using the magnetic powder may be provided.

While exemplary embodiments have been shown and described above, it will be apparent to those skilled in the art that modifications and variations could be made without departing from the scope of the present invention as defined by the appended claims.

What is claimed is:

1. A magnetic powder comprising:

a magnetic particle;

a first coating layer disposed on a surface of the magnetic particle, and containing a first glass; and a second coating layer disposed on the first coating layer, and containing a second glass having a softening point of 20° C. or more lower than that of the first glass, wherein the first and second glass include one or more selected from $P_2O_5$—ZnO based glass and $Bi_2O_3$—$B_2O_3$ based glass.

2. The magnetic powder of claim 1, wherein the magnetic particle includes an iron (Fe) based alloy.

3. The magnetic powder of claim 1, wherein the magnetic particle has a particle size of 5 μm to 100 μm.

4. The magnetic powder of claim 1, wherein the first and second coating layers have different specific resistance values from each other.

5. The magnetic powder of claim 1, wherein the first and second coating layers are made of the first and second glasses, respectively.

6. The magnetic powder of claim 1, wherein a glass transition temperature Tg of the first glass and the second glass is from 300° C. to 550° C.

7. A magnetic material comprising:

a magnetic particle;

a first coating layer completely surrounding the magnetic particle and containing a first glass; and a second coating layer completely surrounding the first coating layer and containing a second glass having a softening point of 20° C. or more lower than that of the first glass, wherein the first and second glass include one or more selected from $P_2O_5$—ZnO based glass and $Bi_2O_3$—$B_2O_3$ based glass.

8. The magnetic material of claim 7, wherein the magnetic particle includes an iron (Fe) based alloy.

9. The magnetic material of claim 7, wherein the magnetic particle has a particle size of 5 μm to 100 μm.

10. The magnetic material of claim 7, wherein the first and second coating layers have different specific resistance values from each other.

11. The magnetic material of claim 7, wherein a glass transition temperature Tg of the first glass and the second glass is from 300° C. to 550° C.

12. An electronic component, comprising:

a body comprising the magnetic material of claim 7;

a coil part disposed in the body; and an external electrode connected to the coil part.

13. An electronic component, comprising:

a body comprising the magnetic powder of claim 1;

a coil part disposed in the body; and an external electrode connected to the coil part.

* * * * *